US005690558A

United States Patent [19]

Huber

[11] Patent Number: 5,690,558

[45] Date of Patent: Nov. 25, 1997

[54] GOLF BALL RETRIEVER

[75] Inventor: Jack A. Huber, Canoga Park, Calif.

[73] Assignee: Larry K. Goodman, Cerritos, Calif.

[21] Appl. No.: 701,642

[22] Filed: Aug. 22, 1996

[51] Int. Cl.[6] ..... A63B 57/00

[52] U.S. Cl. ..... 473/285; 294/19.2; 473/286

[58] Field of Search ..... 473/285, 286; 294/19.2

[56] References Cited

U.S. PATENT DOCUMENTS

| | | | |
|---|---|---|---|
| 3,401,970 | 9/1968 | Russell | 294/19.2 X |
| 3,669,427 | 6/1972 | Curtis | 294/19.2 |
| 4,013,295 | 3/1977 | Baughman | 473/286 |
| 4,787,632 | 11/1988 | Nigrelli et al. | 473/285 |
| 4,968,037 | 11/1990 | Berry | 473/285 |
| 5,004,240 | 4/1991 | Tsukamoto | 473/286 |
| 5,102,139 | 4/1992 | Greig | 473/286 |
| 5,330,177 | 7/1994 | Rogge | 294/19.2 X |

*Primary Examiner*—William H. Grieb
*Attorney, Agent, or Firm*—Charles H. Thomas

[57] ABSTRACT

A golf ball retriever is attached to the handle of a golf putter and is used to retrieve a golf ball from a playing surface and to concurrently deposit a golf ball marker in place of the golf ball. The apparatus includes a fork rotatably mounted to a support body that is secured to the extremity of the handle of a golf club shaft. The fork has a pair of arms which lie substantially in a common plane and are arcuately curved toward each other. One of the arms is longer than the other. A golf ball marker with a turf-engaging spike is placed on the underside of the body supporting the fork and is held thereto by a magnet within the support body. The fork is moved toward the golf ball while residing at a lifting angle inclined about fifteen degrees downwardly relative to the golf club shaft. The arms of the fork engage the undersurface of the golf ball and cradle it therebetween. Once the golf ball has been cradled within the arms of the fork, the shaft is pressed downwardly, thereby engaging the spike of the ball marker in the turf. The fork is then moved laterally away from the ball marker in a scooping motion, thereby overcoming the magnetic force of attraction holding the ball marker to the support. This leaves the golf ball marker in the former position of the golf ball, while the golf ball itself is scooped up.

20 Claims, 6 Drawing Sheets

GOLF BALL RETRIEVER

BACKGROUND OF THE INVENTION

1. Field of the Invention

The present invention relates to an apparatus for use in picking up a golf ball from a playing surface, and for concurrently placing a ball marker at the ball position.

2. Description of the Prior Art

As is well known, the object of the game of golf is to drive a golf ball from a tee location and, with the fewest strokes of a golf club as possible, hit the golf ball into a hole within a surrounding area of low, fine grass called the putting green. During play the presence of an opponent's golf ball sometimes presents a possible obstruction to a player taking a shot. This is particularly true in the area of a putting green. As the golf balls of the players reach an ever closer proximity to the hole, they also often come much closer to the golf balls of other players. To prevent a golf ball of one player from striking that of another, it is an accepted practice, according to the rules of golf, for a player to remove that player's own golf ball from a playing surface until the time for that player's next shot, provided that the exact location of the ball is marked with a ball marker. Conventional ball markers are small, flat articles that are placed on the playing surface at the precise location of the center of the ball that is temporarily removed.

When a golf ball has been temporarily removed from play and replaced with a ball marker, other players can in turn take their shots toward the hole without the hazard of striking the ball of another player. Should a player shoot a golf ball directly through the position from which the ball of another player has been removed, the moving golf ball will merely roll over the flat ball marker, and will not be deflected in its path of travel.

In order to remove a golf ball temporarily from play and replace it with a marker, it has heretofore been necessary for the golfer to stoop over to pick up his or her golf ball and replace the ball with a ball marker. Since this is often done near each hole of play, the effort of stooping over many times in order to retrieve the ball and replace it with a marker becomes tedious, and in some cases tiring. This is particularly true among elderly persons, many of whom play golf for recreational purposes.

SUMMARY OF THE INVENTION

A primary object of the present invention is to provide a device which can be used to retrieve a golf ball from a playing surface without requiring the player to stoop or bend over to any significant extent. To the contrary, the golf ball retriever of the invention can be operated by a golfer standing in a fully erect position to quickly and easily remove a golf ball from a field of play. The golfer is thus relieved of the tiresome necessity for repeatedly bending and stooping in order to pick up a golf ball from the field of play.

A further object of the invention is to provide a golf ball retrieving device that not only allows the golfer to quickly and easily pick up a golf ball without bending over, but with a device that also allows the golfer to concurrently replace the golf ball thus retrieved with a ball marker. Indeed, the apparatus of the invention is so configured that with one smooth, swift movement, a golfer can scoop up a golf ball from a playing surface and place a ball marker at the precise location previously occupied by the ball.

A further object of the invention is to provide a golfer with a golf ball retrieving device that can be attached to the handle of a golfer's putter, and which will not interfere with use of the putter in striking the ball during a put. Indeed, the golf ball retrieving apparatus of the invention is configured in such a manner that it can even serve as an aid to a golfer in assuming a proper stance and making a proper putting stroke.

The present invention is a device that, in its preferred embodiment, may be attached to the end of a golf putter opposite the end of the shaft that carries the putting head by means of a pin that extends into the end of the handle on the golf putter shaft. The device of the invention has a generally horseshoe-shaped ball scooping fork mechanism, having arms of uneven length, which is hinged for rotation about a mounting that attaches to the handle end of the shaft.

The horseshoe-shaped scooping mechanism normally resides in a disposition in which the arms of the scooping fork extend parallel to and along both sides of the shaft. A detent acts between the scooping fork and the mounting structure to hold the arms of the scoop in this orientation.

When the golfer arrives at the site of the ball, the golfer merely rotates the scooping mechanism relative to the golf club shaft until it reaches another detent at an orientation, which is preferably about fifteen degrees from perpendicular alignment relative to the putter shaft. There are preferably two different sets of detents for holding the scooping fork in a golf ball lifting or retrieving position. One of these sets of detents is for right-handed golfers and the other is for left-handed golfers, so that the arms of the fork mechanism may be disposed to extend from either of two diametrically opposite sides of the shaft.

Besides deploying the fork mechanism to extend outwardly from the shaft, at a ball lifting angle relative thereto, the golfer also places a ball marker formed of a material subject to magnetic attraction on the exposed face of the mounting portion of the golf ball retriever. The device employs a magnet which is located within the mounting portion of the golf ball retriever. The ball marker is normally stored in a narrow slot in the mounting portion of the retriever and is held therein by the force of magnetism. The ball marker can be removed, however, and placed on the exposed face of the mounting portion of the golf ball retriever, where it will be held by the force of magnetism until removed by engagement with the turf.

The golfer than inverts the shaft so that the fork which serves as a scoop mechanism resides proximate the ground with the long arm of the scoop fork on the outside away from the golfer's body. The golfer then moves the scoop mechanism toward the golf ball to capture the golf ball within the arms of the scoop. The longer arm of the fork ensures that the fork can slide beneath the golf ball and that the ball is guided onto both forks and cradled therebetween. Once the golf ball has been captured between the fork arms, the golfer pushes downwardly slightly on the shaft, thus driving the spike of the golf ball marker into the ground. The golfer than laterally moves the shaft with the golf ball captured in the scoop away from the marker, which remains in position since its spike is embedded in the turf. The golfer then lifts the shaft upwardly so that the ball can be plucked from the scoop. The golfer is thereby able to easily retrieve a golf ball while concurrently marking its position with a ball marker without having to stoop over at all to pick up the ball or to place the ball marker.

In one broad aspect the present invention may be considered to be an apparatus for retrieving a golf ball from a playing surface comprising a fork and attachment means for securing the fork to an elongated shaft that has a handle end and an opposite end. The attachment means secures the fork to the extremity of the handle end. The fork has first and second arms that are separated from each other and lie substantially in a common plane. The arms of the fork are arcuately curved toward each other so as to receive and cradle a golf ball therebetween. The first arm is longer than the second arm. A means is provided for holding the arms in at least one lifting position in which the arms extend outwardly from the elongated shaft at a predetermined lifting angle that lies between perpendicular alignment relative to the elongated shaft and a thirty degree inclination from perpendicular in a direction away from the opposite end of the elongated shaft.

Preferably the means for holding the fork arms at the lifting position is a detent mechanism. The detent mechanism is comprised of at least one detent finger on the fork projecting toward the mounting structure and a plurality of detent catches in the mounting structure with which the detent finger alternatively lodges. Preferably also the fastener employed to secure the mounting structure to the tip of the golf club shaft handgrip is a sharp pin that penetrates into and is frictionally engaged in the tip of the handgrip.

The support body preferably defines a magnet cavity therewithin, and a magnet is located in the magnet cavity. The golf ball retrieving apparatus also preferably includes a ball marker that is attracted by magnetism and is held magnetically to the support when placed against an exposed surface of the support body. The ball marker remains in this position until it is purposely dislodged therefrom. To this end, the golf ball marker includes a snagging element or spike depending therefrom and extending away from the putter shaft. This snagging element is engaged with the playing surface and is used to dislodge the ball marker from the support body when the snagging element is engaged with the playing surface and the golf club shaft is moved laterally away from the ball marker.

In another aspect the invention may be considered to be a combination of a golf putter having a shaft with a putter head end and a handgrip end and a golf ball retriever. The golf ball retriever of the invention has a support body attached to the extremity of the handgrip end of the shaft, and a fork. The fork has an axle with opposite ends rotatably mounted to the support body and having first and second arms. The arms extend from the axle ends at a common angle relative to the golf putter shaft. The arms are arcuately curved toward and spaced from each other to cradle a golf ball therebetween. The first arm is longer than the second arm. The golf ball retriever also includes a lifting position detent means for releasably holding the fork so that the first and second arms extend at a selected ball lifting angle of within thirty degrees of perpendicularity relative to the shaft. Preferably, the ball lifting angle is about fifteen degrees.

The invention may be described with greater clarity and particularity by reference to the accompanying drawings.

DESCRIPTION OF THE EMBODIMENT

Figure 1:
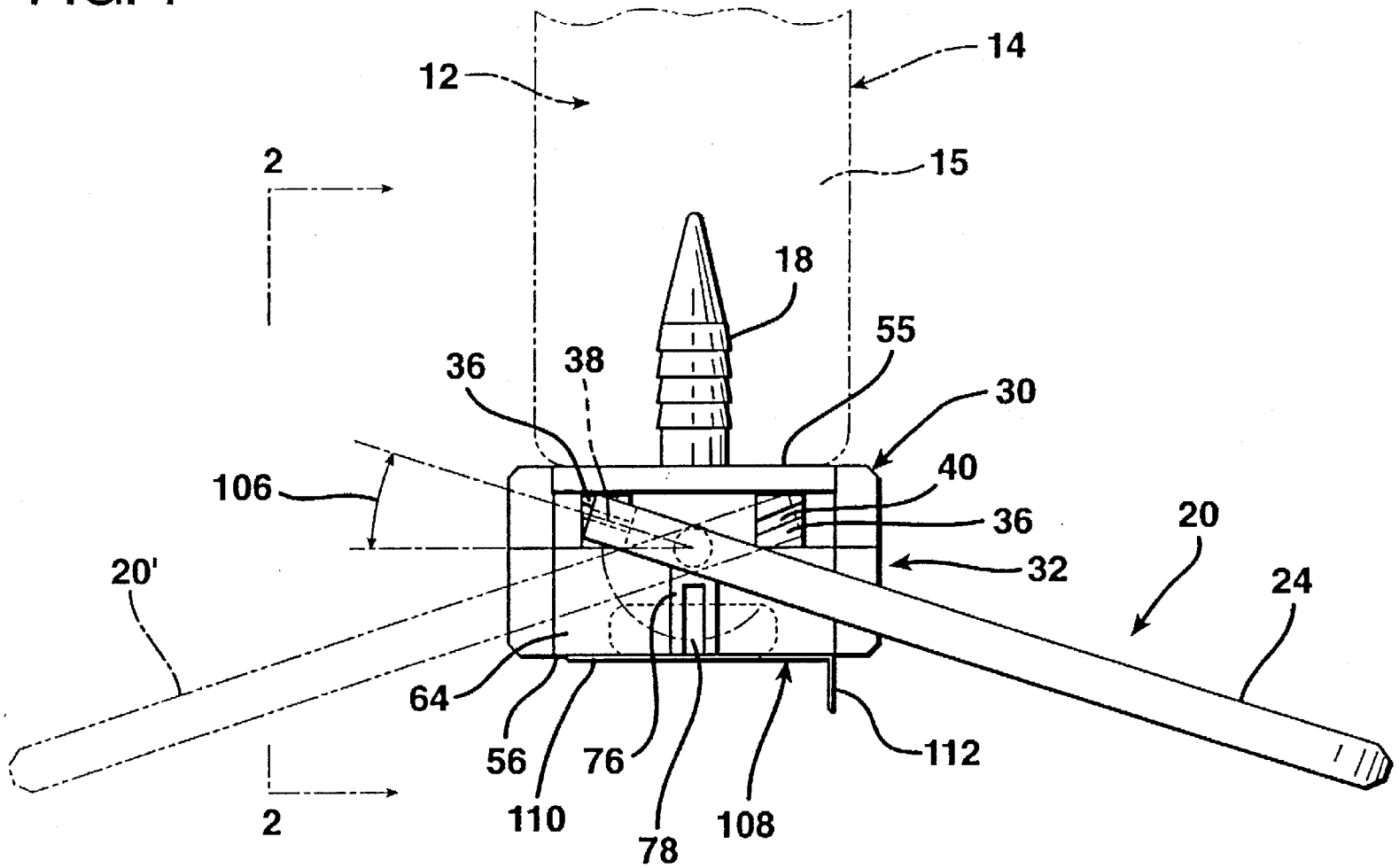
FIG. 1 is a side elevational view illustrating a golf ball retrieving apparatus as mounted on a golf putter shaft according to the invention.
Figure 2:
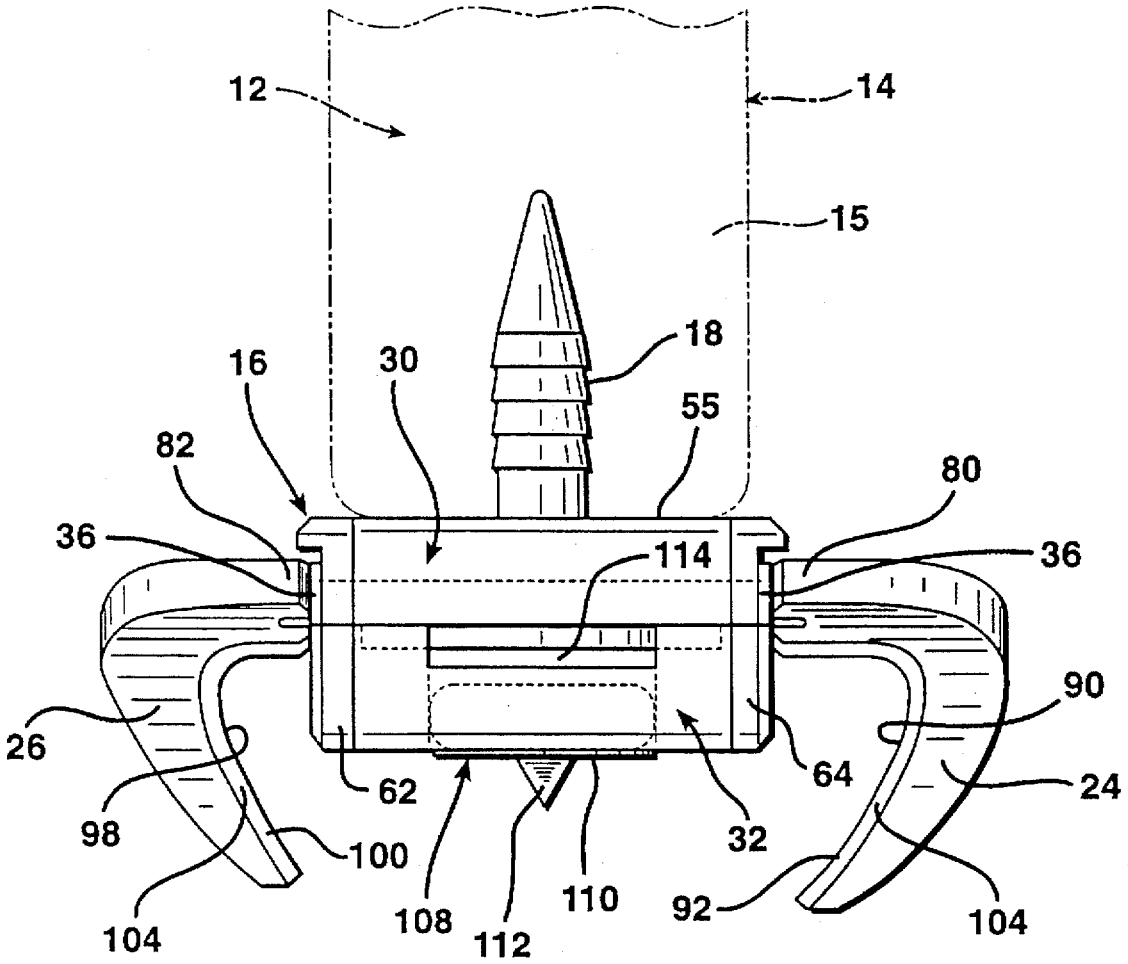
FIG. 2 is a rear elevational view taken along the lines 2—2 of FIG. 1 showing the scooping fork of the golf ball retriever deployed in the lifting position for use.
Figure 3:
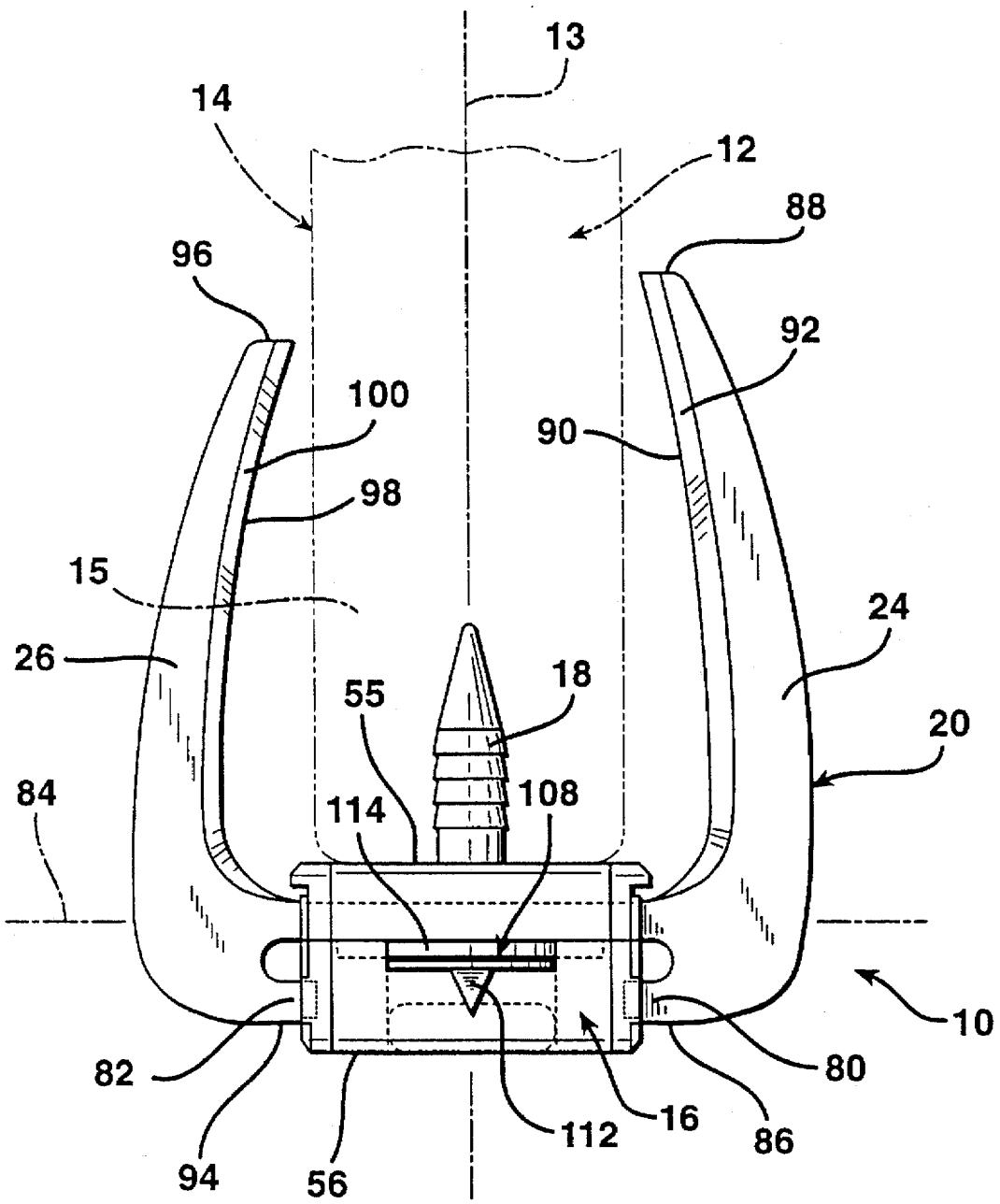
FIG. 3 is a rear elevational view of the golf ball retrieving apparatus shown in its storage position.

FIGS. 1, 2, and 3 illustrate a golf ball retrieving apparatus 10 attached to the shaft 12 of a conventional golf putter 14. The shaft 12 has an upper, putter-head end, not visible in the drawings, and an opposite, handgrip end 15. The longitudinal axis of the golf putter shaft 12 is indicated at 13 in FIG. 3. The golf ball retrieving apparatus 10 is comprised of a generally disk-shaped mounting structure 16, a fastener 18 for securing the mounting structure 16 to the tip of the handgrip end 15 of the golf putter shaft 12, and a fork 20. The fork 20 is comprised of an axle 22, visible in FIG. 4, carried by the mounting structure 16 in a transverse orientation relative to the golf putter shaft 12, as is evident in FIGS. 1–3.

Figure 6:
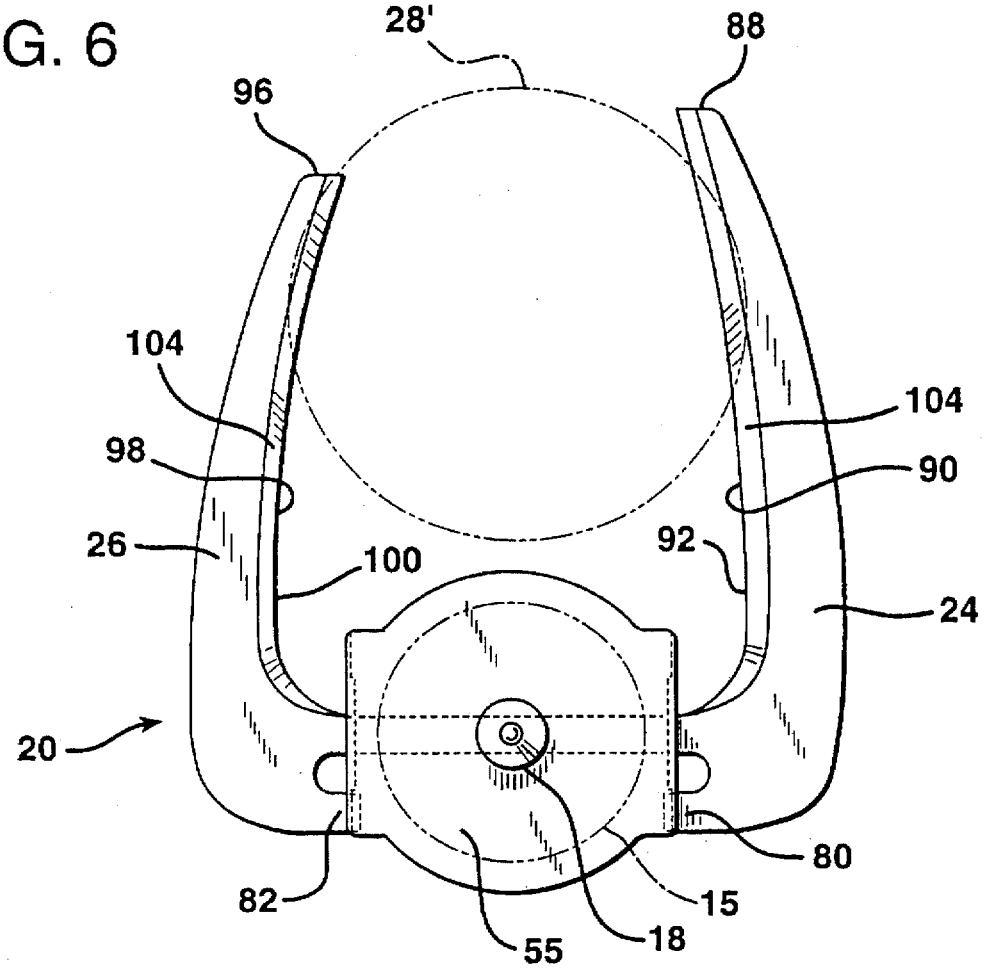
FIG. 6 is a top plan view showing the golf ball retrieving apparatus of the invention deployed for use.
Figure 7:
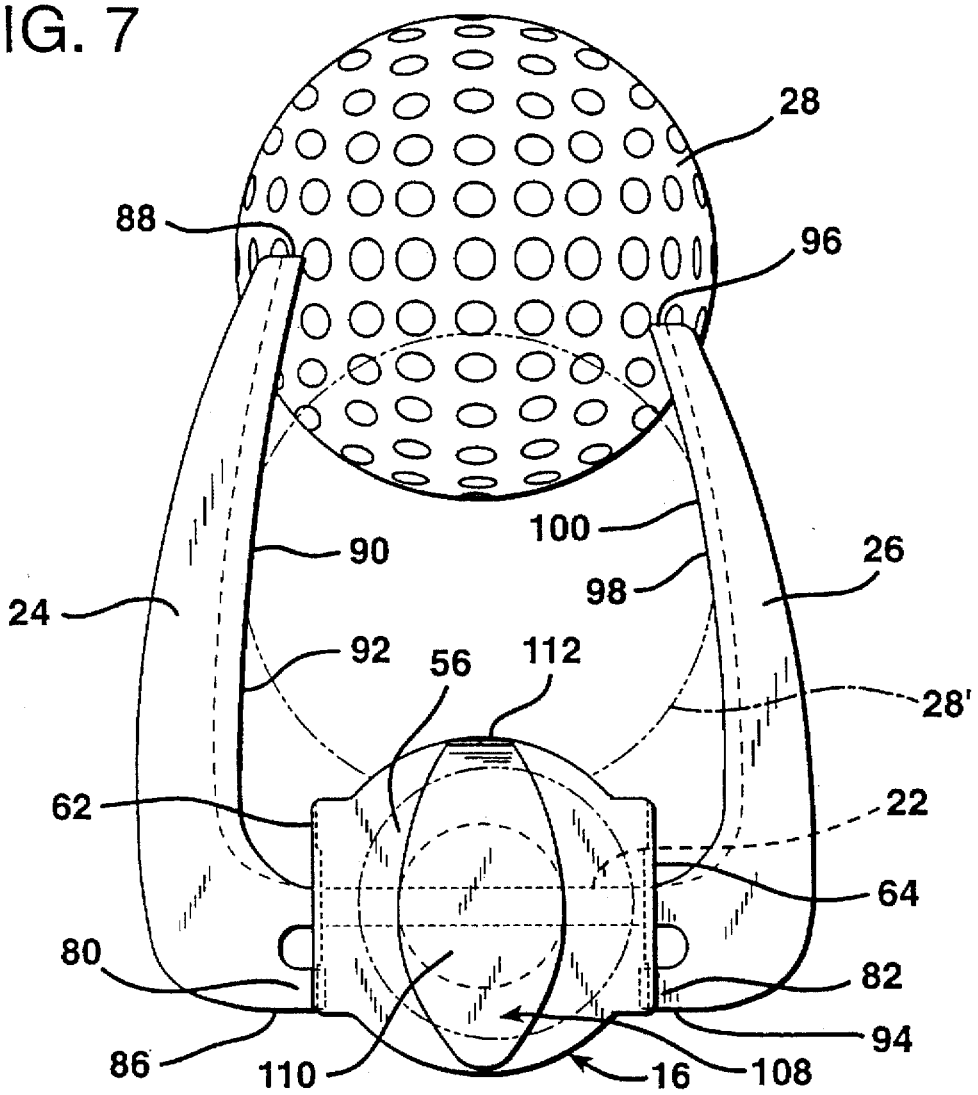
FIG. 7 is a bottom plan view showing use of the golf ball retrieving apparatus according to the invention.

The fork 20 also has first and second arcuately curved arms 24 and 26, respectively, best depicted in FIGS. 3, 4, 6, and 7. The arms 24 and 26 extend from opposite ends of the axle 22. The first arm 24 is between about one-eighth and about one-quarter of an inch longer than the second arm 26. As is evident in FIG. 1, the arms 24 and 26 lie in substantially coplanar relationship. As shown in FIGS. 6 and 7, the fork 20 has a generally horseshoe-shaped configuration and the arms 24 and 26 are configured to cradle a golf ball 28 therebetween.

The golf ball retrieving apparatus 10 also includes a detent mechanism for releasably holding the fork 20 so that the arms project outwardly from the golf putter shaft 12 in a first lifting position at a lifting angle of within thirty degrees of perpendicular orientation relative to the golf putter shaft 12, as illustrated in solid lines in FIG. 1. Specifically, the arms 24 and 26 of the fork 20 reside at an angle of about fifteen degrees below perpendicular alignment relative to the golf putter shaft 12 when the fork 20 is oriented in the first lifting position depicted in FIG. 1. Alternatively, the fork 20 can be rotated on its axle 22 so that the arms 24 and 26 reside alongside the golf putter shaft 12 in substantially coplanar relationship therewith when the fork 20 is in its storage position depicted in FIG. 3.

Figure 4:
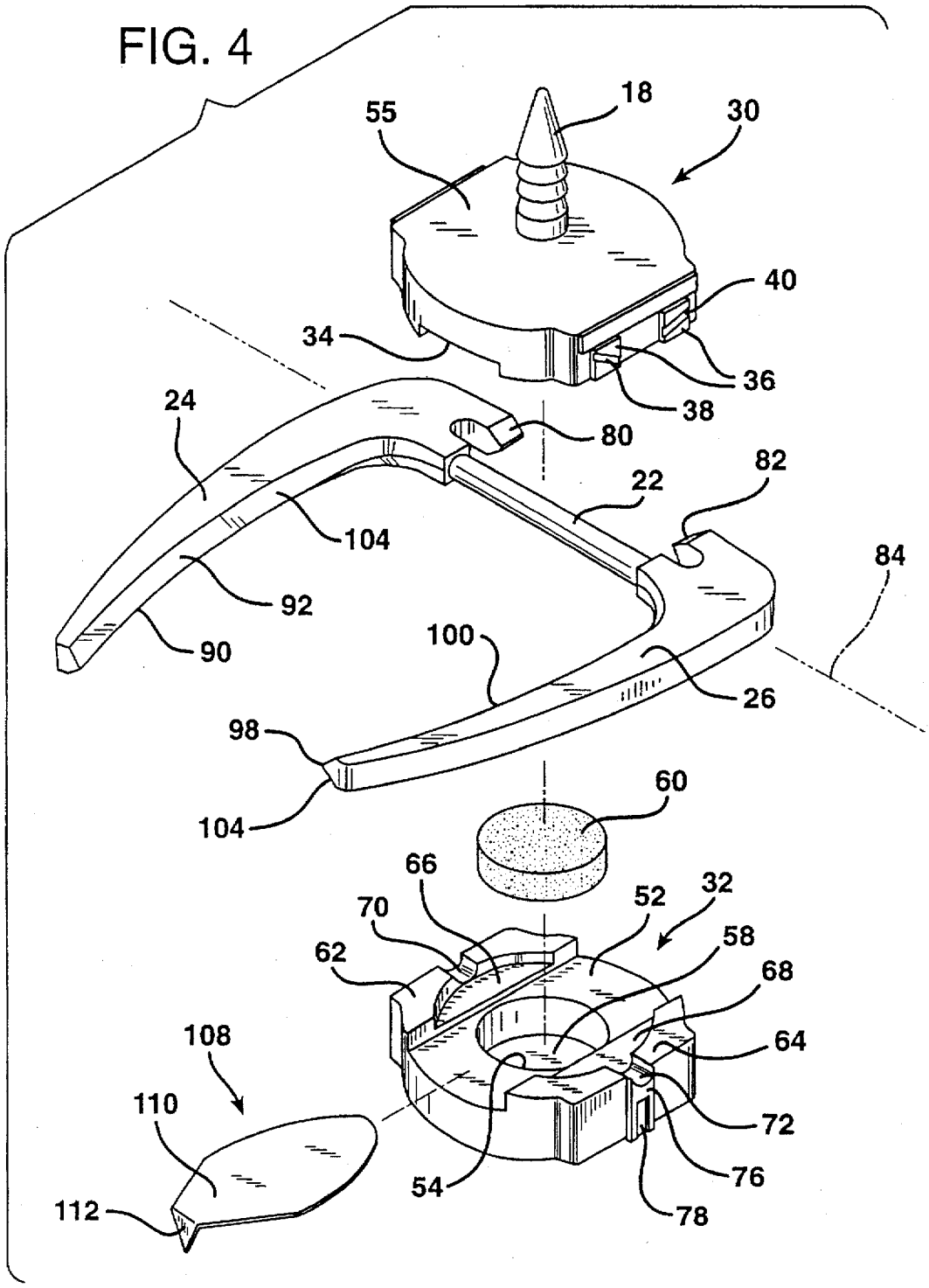
FIG. 4 is an exploded perspective view of a golf ball retrieving apparatus according to the invention.
Figure 5:
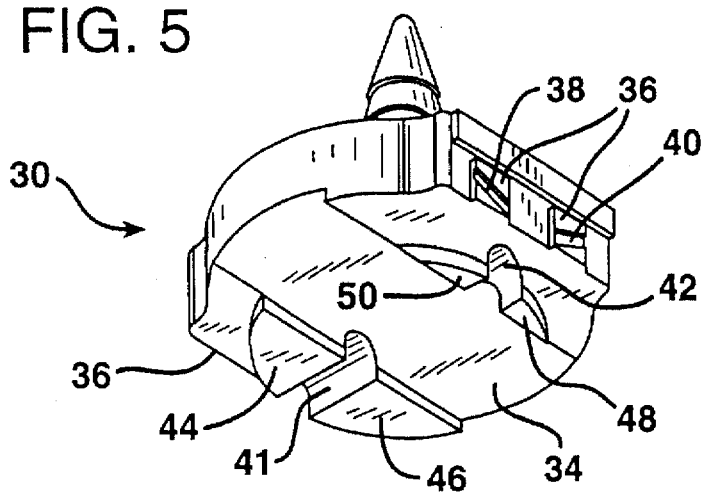
FIG. 5 is a perspective view showing the upper portion of the support of a golf ball retrieving apparatus according to the invention in isolation.

The mounting support 16 is formed of upper and lower, generally disk-shaped members 30 and 32, respectively, best illustrated in FIGS. 4 and 5. The upper mounting support member 30 is a slab-like structure and may be formed of twenty-five percent glass-filled nylon. The upper support member 30 has a flat, upper mounting surface 55 facing the putter handle on the handgrip end 15 of the putter shaft 12. A barbed, pointed fastening pin 18 projects upwardly from the mounting surface 55. The fastening pin 18 is embedded into the handle end 15 of the putter shaft 12, and serves to hold the flat mounting surface 55 of the upper support member 30 in abutment against the transverse tip of the putter handle.

On the side of the upper support member 30 opposite the flat mounting surface 55 there is a downwardly facing channel 34 defined diametrically across the structure of the upper support body 30, as best illustrated in FIG. 5. The channel 34 is of a uniform width throughout and is quite shallow in depth.

At right angles to the channel 34 the upper support member 30 has on each of its opposite sides a pair of outwardly projecting lugs 36 which are raised in relief and define mirror image detent pockets 38 and 40 on both sides of the upper body member 30. The detent pockets 38 and 40 are formed as detent recesses into the structures of the lugs 36 and are inclined at an angle of fifteen degrees relative to the flat, upper mounting surface 55.

On its undersurface the upper mounting support member 30 is further configured with axially projecting protrusions shaped as the remnants of an axial, disk-shaped projection diametrically bisected by the channel 34 in one direction and by semicylindrical grooves 41 and 42 that are oriented perpendicular to the channel 34. The axially projecting remnants of the disk are indicated at 44, 46, 48, and 50 in FIG. 5.

The lower mounting support member 32 is also formed as a slab-like structure of twenty-five percent glass-filled nylon configured with several important features. The upwardly facing side of the lower mounting support structure 32 is bisected by a relatively wide, shallow, diametrically extending channel 52 formed as the mirror image of the channel 34 in the upper mounting support member 30. The lower mounting support member 32 also includes a disk-shaped axial cavity 54 located at the center of the channel 52 and extending axially into the structure of the lower mounting support 32 from the channel 52 to within 0.48 inches of the bottom face of the lower mounting support structure 32. As a consequence, there is a thin, transverse floor 58 residing at the bottom of the disk-shaped cavity 54. The cavity 54 serves as a magnet cavity. As illustrated in FIG. 4, a disk-shaped magnet 60 is located in the magnet cavity 54 and is separated from the lower flat, exposed surface 56 of the mounting support 16 by the thin floor 58 of the cavity 54.

On its upper side the lower mounting support member 32 is formed with radially projecting bulwarks 62 and 64 that provide parallel interior walls for the channel 52. At the centers of the sides of the walls of the channel 52 axially extending, segment-shaped depressions 66 and 68 are defined in the bulwarks 62 and 64 to receive the axial protrusions 44, 46, 48, and 50 from the upper mounting support member 30 therewithin. Semicylindrical-shaped grooves 70 and 72 are defined in the bulwarks 62 and 64 diametrically opposite each other relative to the axis of the mounting support 16, and in perpendicular alignment relative to the orientation of the channel 52.

On the outer, longitudinally extending surfaces of the bulwarks 62 and 64, directly beneath the grooves 70 and 72, there are a pair of radially outwardly projecting lugs 76 with longitudinally extending, rectangular-shaped recesses 78 defined therein. The recesses 78 serve as detent pockets. The detent pockets 78 act as storage position detent means on the support body 16 for releasably holding the arms 24 and 26 of the fork 20 in a storage orientation extending alongside the putter shaft 12 as illustrated in FIG. 3.

Figure 8:
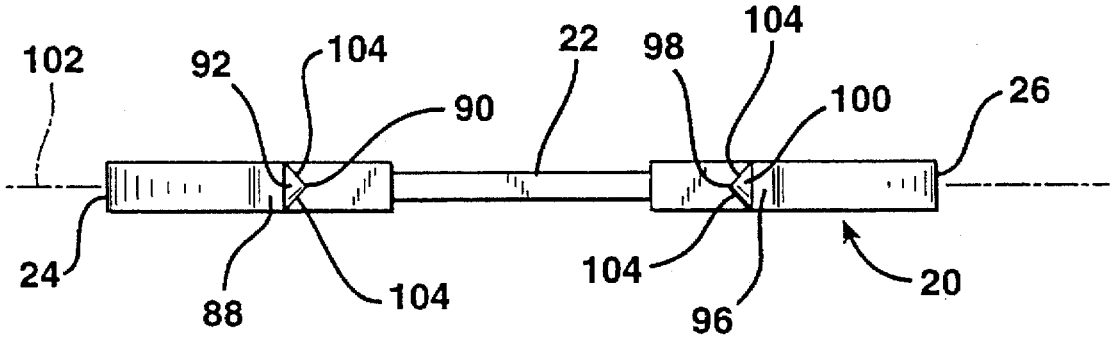
FIG. 8 is a front elevational view of the scooping fork shown in isolation.

The fork 20 may be formed of 6061 forged aluminum and is best illustrated in FIGS. 3, 4, and 8. As shown in FIG. 4, the fork 20 is provided with a pair of detent fingers 80 and 82 that are directed toward each other and which narrow at their extremities, but are flattened or rounded at their tips. The detent fingers 80 and 82 are alternatively engageable with the different sets of detent pockets formed in the support body 16 to alternatively hold the fork 20 with the arms 24 and 26 thereof at the ball lifting angle, illustrated in FIG. 1, and at the storage orientation depicted in FIG. 3.

The axle 22 is formed as a cylindrical rod and carries the fork arms 24 and 26 in substantially coplanar relationship at its opposite ends. The size, shape, and spacing of the fork arms 24 and 26 are extremely important, since the arms 24 and 26 must be configured to cradle a golf ball.

A regulation size golf ball is a dimpled, spherical structure which has a minimum diameter of 1.68 inches as required by the USGA standard. The detent-engaging fingers 80 and 82 extend a maximum distance of 0.313 inches from the axis 84 of the axle 22. The distance from the back edge 86 of the finger 80 to the distal tip 88 of the long arm 24 is 2.281 inches. The radius of curvature of the curved, linear apex 90 of the inwardly facing edge 92 of the long arm 24 is four inches from the tip 88 to the location of the transition between the arm 24 and the axle 22. At the tip 88 of the arm 24 the apex 90 thereof lies at a distance of 0.530 inches from the axis 13 of the putter shaft 12 when the fork 20 is in the storage position shown in FIG. 3.

The distance from the back surface 94 of the finger 82 to the tip 96 of the arm 26 is 2.066 inches. The radius of curvature of the linear apex 98 of the inner edge 100 of the shorter arm 26 is also four inches from the tip 96 back to the transition between the arm 26 and the axle 22. The distance of the apex 98 from the shaft axis 13 at the tip 96 of the shorter arm 26 is 0.529 inches when the fork 20 is in the storage position shown in FIG. 3.

The arms 24 and 26 define a gap therebetween, as measured between the apices 90 and 98 of their interior edges 92 and 100, respectively. This gap varies between about one and about one and a half inches over the coextensive portions of the arms 24 and 26. As best illustrated in FIG. 8, the interior, mutually facing edges 92 and 100 of the arms 24 and 26, respectively, both narrow in cross section toward each other and terminate in their respective linear apices 90 and 98 that lie on a transverse center plane 102. The transverse center plane 102 passes through and bisects the fork 20 through its length. As illustrated in FIG. 8, the interior edges 92 and 100 are tapered toward each other to form surfaces 104. The surfaces 104 are all tapered toward the transverse center plane 102 at an angle of about forty-five degrees, both above and below the transverse center plane 102. Both of the apices 90 and 98 are rounded at a radius of 0.30 inches.

The operation of the golf ball retrieving apparatus 10 is best illustrated in FIGS. 1, 2, 6, and 7. As shown in FIG. 1, the fork 20 is rotatably carried by the fork support body 16 to rotate relative thereto. The axle 22 rotates within the bearings defined by the grooves 41, 42 and 70, 72 in the upper and lower mounting support members 30 and 32 respectively. The apparatus 10 employs a multiple-position detent mechanism having first, second, and third detent components. The first detent component is formed by the detent pockets 38 which releasably hold the arms 24 and 26 of the fork 20 in the lifting position in which the fork 20 resides at an angle of fifteen degrees relative to the shaft axis 13, as depicted in solid lines in FIG. 1. This is the lifting position at which the fork 20 would be deployed by a right-handed golfer retrieving a golf ball, as depicted in FIGS. 6 and 7.

The detent pockets 78 serve as the second detent component for releasably holding the fork arms 24 and 26 in an inactive position in which they reside alongside the putter shaft 12 in substantially coplanar relationship therewith, as illustrated in FIG. 3. That is, the fork 20 is rotated until the fingers 80 and 82 engage the detent pockets 78, at which time the shaft axis 13 lies in the transverse center plane 102 of the fork 20.

FIG. 3 illustrates the arms 24 and 26 of the fork 20 in their storage positions. The arms 24 and 26 are held in their storage positions by engagement of the fork fingers 80 and 82 in the detent pockets 78 on the opposites sides of the support body 16.

With the fork 20 in the position depicted in FIG. 3, a golfer can use the putter by gripping the handgrip 14 at some distance from the extremity of the handgrip end 15 of the shaft 12, which is the normal location at which a golf putter is held. Since the golf ball retrieving apparatus 10 is mounted on the very tip of the shaft 12 remote from the putter head, it does not interfere with the golfer's grip on the handgrip end 15 of the golf putter 14. In fact, the arms 24 and 26 even serve as reference indicia for use by the golfer in gripping the putter.

The detent pockets 40 form a third detent component for releasably holding the arms 24 and 26 in a second lifting position, at the same fifteen degree angle as the first lifting position, but on the opposite side of the putter shaft 12. The fork 20 is shown in the second lifting position at 20' in phantom in FIG. 1. As illustrated in that drawing figure, the arms 24 and 26 of the fork 20 reside on diametrically opposite sides of the axis 13 of the putter shaft 12 when the fork 20 alternatively resides in the two lifting positions. The lifting angle 106, shown in FIG. 1, is about fifteen degrees from perpendicular alignment relative to the axis 13 of the putter shaft 12.

A further important feature of the invention is the provision of a golf ball marker 108, which is attracted by magnetism. The ball marker 108 may, for example, be formed of certain types of stainless steel which are attracted by the force of magnetism, as well as other types of steel and other ferrous and nonferrous magnetic material as well.

The body 110 of the ball marker 108 is formed as a thin, flat, oblong sheet of a material. At one end the ball marker 108 has a down-turned toe or spike 112 that serves as a snagging element. The turf-engaging spike 112 projects downwardly, depending from one side of the flat metal body 110 of the ball marker 108.

When the component parts of the golf ball retrieving apparatus 10 are assembled together, the channels 34 and 52 in the mounting support top member 30 and the mounting support bottom member 32 reside in mutually facing and longitudinally aligned relationship so as to form a relatively wide, narrow ball marker storage slot 114, visible in FIG. 2. The ball marker storage slot 114 resides at the interface between the upper and lower support mounting members 30 and 32 and is configured to receive the flat metal body 110 of the ball marker 108 therewithin.

When the body 110 of the ball marker 108 is inserted into the slot 114, as depicted in FIG. 3, it is held therewithin by the magnetic force of attraction of the magnet 60. The slot 114 thereby serves as a convenient means of storing the ball marker 108.

Before utilizing the apparatus 10 the golfer first removes the ball marker 108 from the slot 114. The golfer pulls the marker 108 longitudinally out of the slot 114 by gripping the spike 112. The golfer then places the top surface of the ball marker body 110 against the flat, exposed surface 56 of the support body 16 in the position depicted in FIGS. 1 and 7. Once the ball marker 108 has been placed in the position illustrated in FIG. 1, with the body 110 of the ball marker 108 residing in contact with the surface 56 and with the spike 112 depending beneath the ball marker body 110, the magnetic force of attraction of the magnet 60 is sufficient to hold the ball marker 108 in the position illustrated in FIG. 1. The floor 58 of the magnet cavity 54 is thin enough so that the magnetic force easily acts through the floor 58. Nevertheless, the floor 58 does serve the purpose of containing the magnet 60 within the magnet cavity 54.

To retrieve a golf ball 28 utilizing the golf ball retrieving apparatus 10, a golfer approaches the ball 28 to be retrieved and dislodges the fork fingers 80 and 82 from the detent pockets 78. The golfer then rotates the fork 20 to the first lifting position indicated in solid lines in FIG. 1, if the golfer is right-handed. With the fork 20 in the first lifting position depicted in solid lines in FIG. 1, the fork fingers 80 and 82 are releasably engaged in the detent pockets 38 on both sides of the support body 16.

The golfer then turns the putter upside down, holding it at the putter head end with the fork 20 touching the turf of the golf green. While holding the putter shaft 12 in the right hand the golfer moves the apparatus 10 forwardly toward the golf ball 28, keeping the ball 28 roughly centered between the two arms 24 and 26, as depicted from beneath in FIG. 7. Since the arm 24 is longer than the arm 26, it will establish contact with the golf ball 28 first and guide the golf ball 28 into a cradled position atop and between the arms 24 and 26, as illustrated in phantom in FIGS. 6 and 7.

Once the golf ball 28 reaches the position shown in phantom at 28' in FIGS. 6 and 7, the golfer pushes the handle end 15 of the shaft 12 downwardly slightly, thus embedding the spike 112 of the ball marker 108 in the putting green surface therebeneath. The golfer then moves the fork 20 forwardly, thereby scooping up the golf ball 28 from the playing surface. Since the spike 112 of the ball marker 108 depends downwardly from beneath the support body 16 as depicted in FIGS. 1 and 7, and is snagged in the golf green turf, the ball marker 108 remains in engagement with the golf green as the handle end 15 of the putter shaft 12 is moved laterally away. The golfer continues to move the putter forwardly slightly, thus completing a scooping movement beneath the golf ball 28.

The spike 112 of the ball marker 108 remains engaged with the playing surface, so that the forward movement of the handle end 15 of the golf putter shaft 12 dislodges the ball marker 108 from the support body 16 since the spike 112 remains engaged with the turf. The forward force exerted on the shaft 12 of the golf ball putter is sufficient to overcome the magnetic force of attraction by which the ball marker 108 is otherwise held to the exposed surface 56 of the support body 16.

Once the golf ball 28 has been scooped up and is cradled within the fork 20 in the manner illustrated in phantom in FIG. 7, the golfer merely raises the shaft 12 vertically upwardly and manually removes the golf ball 28 from its cradled position in the fork 20. Thus, the golfer can retrieve the golf ball 28 and concurrently replace it with the ball marker 108 without ever bending over.

If the golfer is left-handed, the golf ball retrieving apparatus will be used in a slightly different but directly analogous manner. Specifically, instead of deploying the fork 20 in the lifting position depicted in solid lines in FIG. 1, the golfer rotates the fork 20 to the opposite side of the shaft 12 until the fork fingers 80 and 82 engage the detent pockets 40 on the sides of the support body 16. The golfer than approaches the ball and lifts it from the surface in the same manner as a right-handed golfer, but with the shaft 12 of the golf putter held in the golfer's left hand. In either event, the golfer approaches the golf ball 28 so that the long arm 24 of the fork 20 is inserted beneath the outside portion of the golf ball 28. That is, the shorter arm 26 will always be located between the golfer and the ball 28.

Undoubtedly, numerous variations and modifications of the invention will become readily apparent to those familiar with golf equipment. For example, the golf ball retrieving apparatus need not necessarily be mounted on the end of an actual putter, but could be mounted on the end of a shaft dedicated specifically for use with the ball retrieving apparatus 10. Also, while the fork is preferably rotatable between the different detent positions illustrated, embodiments of the invention can be constructed in which the fork 20 remains at a fixed lifting angle relative to a shaft.

Another modification which can be made is to configure the exposed surface 56 of the lower mounting support member 32 with a pair of very small fore and aft tracks which may be 0.025 inches in height and 0.030 inches in width. These tracks can extend parallel to each other and to the slot 114 and are spaced apart in distance equal to the width of the slot 114. Such tracks aid in holding the ball marker 108 straight as the shaft 12 is moved forward to retrieve the golf ball 28, once the spike 112 of the ball marker 108 has been engaged in the turf.

Accordingly, the invention should not be construed as limited to the specific embodiment depicted and described.

I claim:

1. Apparatus for retrieving a golf ball from a playing surface comprising a fork and attachment means for securing said fork to an elongated shaft that has a handle end and an opposite end, wherein said attachment means secures said fork to the extremity of said handle end, and wherein said fork has first and second arms separated from each other and lying substantially in a common plane and arcuately curved toward each other so as to receive and cradle a golf ball therebetween and said first arm is longer than said second arm, and means for holding said arms in at least one lifting position in which said arms extend outwardly from said elongated shaft at a predetermined lifting angle between perpendicular alignment relative to said elongated shaft and a thirty degree inclination from perpendicularity in a direction away from said opposite end of said elongated shaft.

2. Apparatus according to claim 1 wherein said elongated shaft is a golf putter shaft and further comprising a fork support body to which said attachment means is fastened and said fork is rotatably carried by said fork support body to rotate relative thereto, and said means for holding said arms in said at least one lifting position is a multiple-position detent mechanism with a first detent component for releasably holding said arms in said at least one lifting position as aforesaid, and a second detent component for releasably holding said arms in an inactive position in which said arms reside alongside said putter shaft in substantially coplanar relationship therewith.

3. Apparatus according to claim 2 wherein said support body has a mounting surface facing said handle end of said putter shaft and an opposite, exposed surface, and said support body defines a magnet cavity therein, and further comprising a magnet located in said magnet cavity, and a ball marker that is attracted by magnetism and held magnetically to said support when placed against said exposed surface of said support body until dislodged therefrom, and said ball marker includes a snagging element depending therefrom away from said putter shaft and engageable with said playing surface to dislodge said ball marker from said support body when engaged with said playing surface.

4. Apparatus according to claim 3 wherein said ball marker is formed as a flat member from which said snagging element depends, and said support body is formed with a ball marker storage slot therein which receives said flat member of said ball marker for storage therewithin.

5. Apparatus according to claim 2 wherein said detent mechanism is comprised of a third detent component for releasably holding said arms in a second lifting position at the same predetermined lifting angle as aforesaid, and said first and second lifting positions are on diametrically opposite sides of said putter shaft.

6. Apparatus according to claim 2 wherein said detent components are comprised of detent recesses on said fork support body, and said fork includes at least one finger alternatively engageable in said detent recesses.

7. Apparatus according to claim 1 wherein said predetermined lifting angle is about fifteen degrees from perpendicular alignment relative to said putter shaft.

8. Apparatus according to claim 1 wherein said arms define a gap therebetween of between about one and about one and one-half inches, said first arm is between about one-eighth and about one-quarter of an inch longer than said second arm, and both of said arms have interior mutually facing edges that narrow in cross section toward each other.

9. A golf ball retrieving apparatus comprising: a mounting structure, a fastener for securing said mounting structure to the top of the handgrip of a golf club shaft, a fork comprised of an axle carried by said mounting structure in a transverse orientation relative to said golf club shaft, and first and second arcuately curved arms extending from opposite ends of said axle, wherein said first arm is longer than said second arm, and wherein said arms lie in substantially coplanar relationship and are configured to cradle a golf ball therebetween, and a detent mechanism for releasably holding said fork so that said arms project outwardly from said golf club shaft at a lifting angle of within thirty degrees of perpendicular orientation relative to said golf club shaft, and alternatively so that said arms reside alongside said golf club shaft in substantially coplanar relationship therewith.

10. A golf ball retrieving apparatus according to claim 9 wherein said fork arms have mutually facing interior edges that are tapered toward each other.

11. A golf ball retrieving apparatus according to claim 10 wherein said interior edges of said fork arms are tapered toward each other at the same angle of taper both above and below a transverse center plane passing therethrough.

12. A golf ball retrieving apparatus according to claim 11 wherein said angle of taper is about forty-five degrees relative to said transverse center plane.

13. A golf ball retrieving apparatus according to claim 9 wherein said mounting structure has a flat mounting surface bearing said fastener for disposition in contact with said top of said handgrip and an opposite, flat, exposed surface, and further comprising a magnet in said mounting structure and a ball marker formed of a flat, ferrous metal member with a turf engaging spike projecting from one side of said flat, metal marker.

14. A golf ball retrieving apparatus according to claim 13 wherein said mounting structure is provided with a ball marker storage slot configured to receive said flat metal member of said ball marker therewithin.

15. A golf ball retrieving apparatus according to claim 9 wherein said detent mechanism is comprised of at least one detent finger on said fork projecting toward said mounting structure and a plurality of detent catches in said mounting structure with which said detent finger alternatively lodges.

16. A golf ball retrieving apparatus according to claim 9 wherein said fastener is a sharp pin that penetrates into and is frictionally engaged in said top of said handgrip.

17. In combination, a golf putter having a shaft with a putter head end and a handgrip end and a golf ball retriever having a support body attached to the extremity of said handgrip end of said shaft, a fork having an axle with opposite ends rotatably mounted to said support body and having first and second arms extending from said axle ends at a common angle relative to said golf putter shaft and said arms are arcuately curved toward and spaced from each other to cradle a golf ball therebetween, and said first arm is longer than said second arm, and lifting position detent means for releasably holding said fork so that said first and second arms extend at a selected ball lifting angle of within thirty degrees of perpendicularity relative to said shaft.

18. A combination according to claim 17 further comprising storage position detent means on said support body for releasably holding said fork arms in a storage orientation extending alongside said putter shaft.

19. A combination according to claim 17 wherein said ball lifting angle is about fifteen degrees.

20. A combination according to claim 19 wherein said fork is provided with detent fingers spaced from said axle proximate each of said arms, and said detent means is comprised of sets of detent pockets in said support body engageable by said detent fingers to hold said fork with said arms thereof at said ball lifting angle and alternatively at said storage orientation.

* * * * *